US010226711B1

(12) United States Patent
Jin

(10) Patent No.: US 10,226,711 B1
(45) Date of Patent: Mar. 12, 2019

(54) ARBITRARILY SHAPED SKELETON

(71) Applicant: Mei Lan Jin, Dongguan (CN)

(72) Inventor: Mei Lan Jin, Dongguan (CN)

( * ) Notice: Subject to any disclaimer, the term of this patent is extended or adjusted under 35 U.S.C. 154(b) by 0 days.

(21) Appl. No.: 15/693,495

(22) Filed: Sep. 1, 2017

(51) Int. Cl.

| | |
|---|---|
| ***A63H 3/04*** | (2006.01) |
| ***A63H 3/28*** | (2006.01) |
| ***A63H 3/48*** | (2006.01) |
| ***A63H 3/46*** | (2006.01) |

(52) U.S. Cl.
CPC ..... *A63H 3/04* (2013.01); *A63H 3/28* (2013.01); *A63H 3/46* (2013.01); *A63H 3/48* (2013.01)

(58) Field of Classification Search
CPC ..... A63H 3/04
See application file for complete search history.

(56) References Cited

U.S. PATENT DOCUMENTS

| | | | | |
|---|---|---|---|---|
| 1,189,585 | A * | 7/1916 | Kruse | A63H 3/04 223/66 |
| 1,409,411 | A * | 3/1922 | Rogers | A63H 3/04 446/374 |
| 3,266,059 | A * | 8/1966 | Stelle | B25J 9/06 138/120 |
| 9,132,340 | B2 * | 9/2015 | Fish | A63F 3/00 |
| 2014/0199912 | A1 * | 7/2014 | Fish | A63H 33/086 446/383 |

* cited by examiner

*Primary Examiner* — John Ricci

(57) ABSTRACT

An arbitrarily shaped skeleton, comprising: a main frame body and limbs disposed on the main frame body; wherein the main frame body is formed with mounting holes for mounting the limbs, one end of the limb is mounted in the mounting hole, and the limb is made of a telescopic structure which can be arbitrarily bent and stretched. The doll made by the skeleton can make a variety of poses, and when the limbs are stretched, the limbs can have the sound of plastic deformation, it is more interesting. The main frame and limbs are made of plastic injection molding, and its cost is low and easy to assemble, simplifying the production process and having more market competitiveness.

7 Claims, 5 Drawing Sheets

ARBITRARILY SHAPED SKELETON (1) Field of the Invention

The present invention relates to a doll structure technical field, particularly to an arbitrarily shaped skeleton.

(2) Description of the Related Art

Dolls are a kind of toys, the general doll has a skeleton, after the skeleton of the doll is finished, the outer layer of the skeleton will be wrapped with cotton or other material to make the appearance of the doll even more beautiful to attract the consumer.

The traditional doll skeleton is fixed, the skeleton includes: the main limb and the limbs installed on the main limb. In general, the traditional skeletal limbs are not stretchable and can not be bent, limbs installed in the main limb on the four mounting holes, the limbs can only be rotated around the connection of the main limb and can not be stretched or bent, so this greatly reduces the fun of dolls. As a result, the manufacturer has begun to develop a doll skeleton that allows the limbs to bend arbitrarily. The prior art has a doll skeleton whose limbs are made of silicone-coated memory metal, which is flexible and can be bent arbitrarily, but in order to increase the hardness of the limbs, the cross-section view of the limbs are designed to be like a gourd-shaped structure, so that the limbs can be arbitrarily bent.

However, the dolls made by the above-mentioned method have high manufacturing cost and complicated assembling, and the limbs used in the above-mentioned techniques can only be bent and can not be freely stretched.

SUMMARY OF THE INVENTION

The technical problem to be solved by the present invention is to provide an arbitrarily shaped skeleton.

For solving the above mentioned problems, the technical scheme is to provide an arbitrarily shaped skeleton, comprising:

a main frame body and limbs disposed on the main frame body;

wherein the main frame body is formed with mounting holes for mounting the limbs, one end of the limb is mounted in the mounting hole, and the limb is made of a telescopic structure which can be arbitrarily bent and stretched.

More preferably, wherein the mounting holes are threadedly connected to the limbs.

More preferably, wherein the limbs are hollow tubes, and the walls thereof are formed in a stretchable pleated shape.

More preferably, wherein the main frame body includes an upper frame and a lower frame, and the upper frame and the lower frame are connected by a pipe body, the upper frame and the lower frame are formed with the mounting holes at both ends thereof; four limbs are installed in the mounting holes of the upper and lower frames to form a skeleton.

More preferably, wherein the pipe body is a rigid structure.

More preferably, wherein the pipe body is a stretchable structure.

More preferably, wherein the upper frame is in a cross shape, the lower frame is in a T-shape; the upper frame includes connecting holes disposed in upper and lower ends thereof, the lower frame also includes the connecting hole disposed at an upper end thereof, both ends of the pipe body are attached to the connecting holes of the upper frame and the lower frame so that the upper frame and the lower frame are connected.

More preferably, wherein the lower frame includes a hole disposed on a front side or a back side thereof for mounting a tail.

The technical effect achieved by the present invention is:

Compared with the prior art, the present invention uses the stretchable tube as the skeleton of the limbs, so that the limbs can be stretched and bent, the doll made by the skeleton can make a variety of poses, and when the limbs are stretched, the limbs can have the sound of plastic deformation, it is more interesting. The main frame and limbs are made of plastic injection molding, and its cost is low and easy to assemble, simplifying the production process and having more market competitiveness.

DETAILED DESCRIPTION OF THE INVENTION

The present invention will now be further described with reference to specific embodiments and the drawings.

Figure 1:
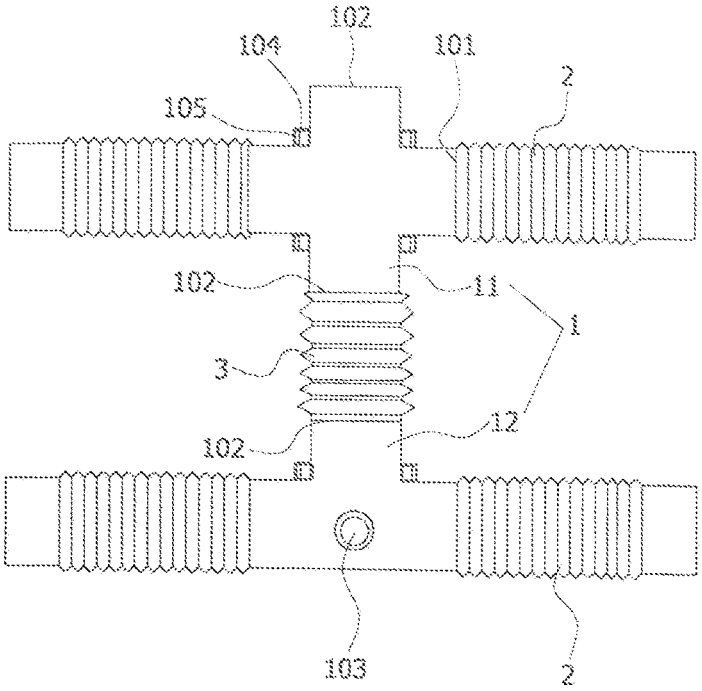
FIG. 1 is a schematic structural view of a first embodiment of the present invention.
Figure 2:
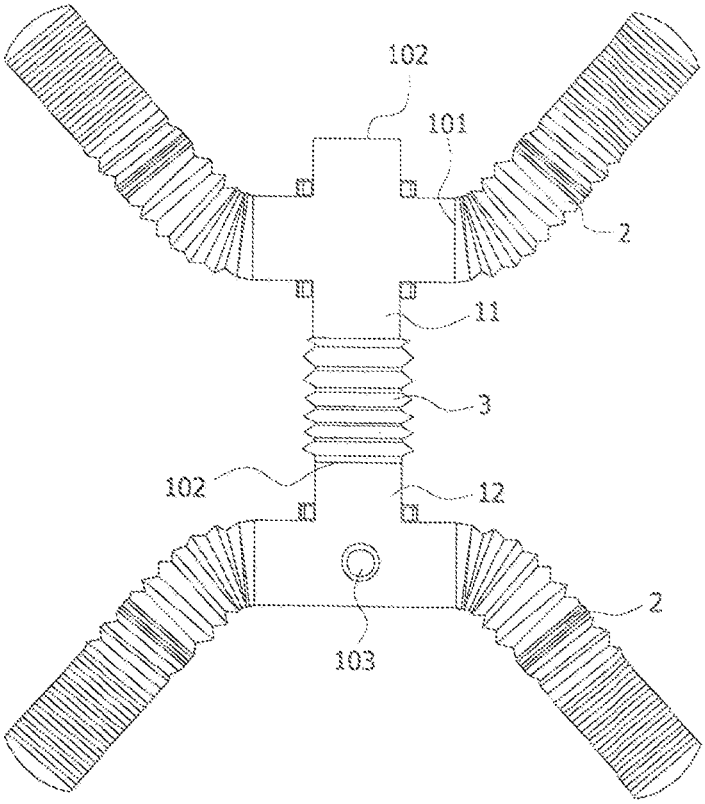
FIG. 2 is a schematic structural view of a bending state of the first embodiment of the present invention.
Figure 3:
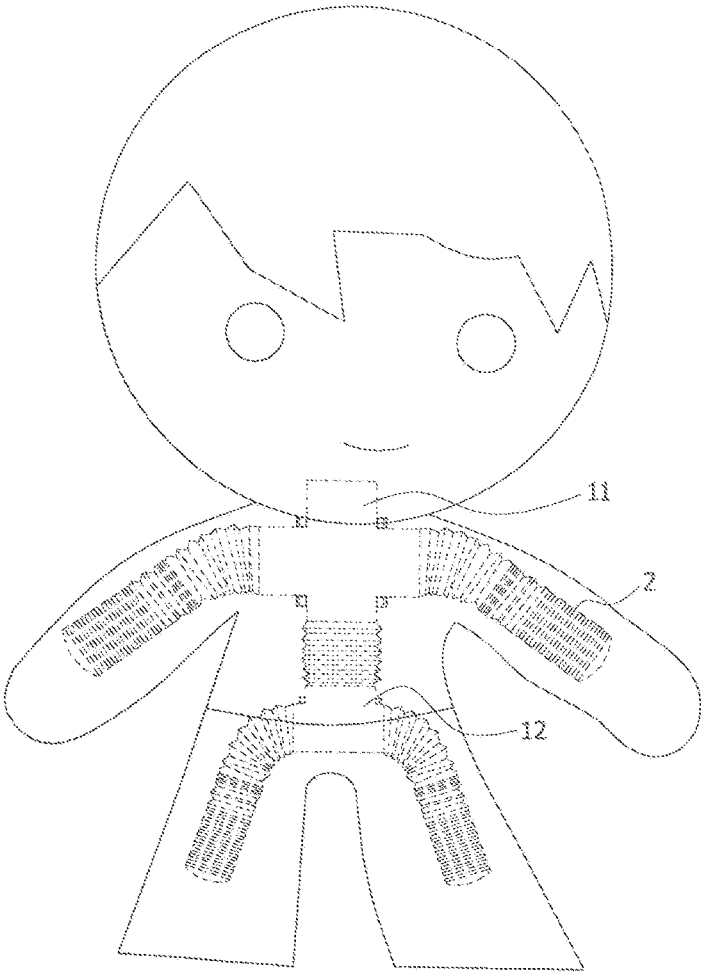
FIG. 3 is another schematic structural view of the first embodiment of the present invention.

The present invention is an arbitrarily shaped skeleton, the first embodiment comprises a main frame body (1) and limbs (2) disposed on the main frame body (1). The main frame body (1) and the limbs (2) form a skeleton as shown in FIGS. 1-2. An outer layer of material that is covered outside the skeleton can form a doll as shown in FIG. 3.

The main frame body (1) and the limbs (2) are made of plastic injection molding, the cost is low, and the processing is simple, suitable for mass production. In the present embodiment, there is a main frame body (1) and are four limbs (4), the limbs (2) are mounted on both sides of the main frame body (1) to form a skeleton similar to a person or an animal.

The main frame body (1) includes an upper frame (11) and a lower frame (12), and the upper frame (11) and the lower frame (12) are connected by a pipe body (3), the upper frame (11) is in a cross shape, the lower frame (12) is in a T-shape, the upper frame (11) and the lower frame (12) are provided with mounting holes (101) at both ends thereof, and the limbs (2) are mounted in the mounting holes (101). The upper frame (11) includes connecting holes (102) disposed in upper and lower ends thereof, the lower frame (12) also includes the connecting hole (102) disposed at an upper end thereof, both ends of the pipe body (3) are attached to the connecting holes (102) of the upper frame (11) and the lower frame (12) so that the upper frame (11) and the lower frame (12) are connected.

The mounting holes (101) and the connecting holes (102) have internal threads, and one end of the limb (2) and the pipe body (3) have external threads so that the limb (2) and the pipe body (3) are screwed into the mounting holes (101) and the connecting holes (102); the upper frame (11), the lower frame (12), the limbs (2) and the pipe body (3) can be separately produced, after the production, the assembly can be completed by a simple thread connection, so that the assembly is simple, and the upper frame (11), the lower frame (12), the limbs (2) and the pipe body (3) are made of plastic material, and the cost is low.

In addition, the upper frame (11) and the lower frame (12) are provided with front and rear fastening structures for ease of production. In particular, the upper frame (11) includes symmetrical front and rear portions, and the front and rear portions are engaged with each other through snap connectors (104, 105) to form a cross-shaped pipe. Likewise, the lower frame (12) also uses this similar structure. The structure is intended to facilitate production and further reduce production costs.

The limb (2) and the pipe body (3) are stretchable and hollow structures, the pipe walls of which are pleated, and can be bent and stretched; when the limbs (2) and the pipe body (3) are mounted on the main frame body (1), the limbs (2) and the pipe body (3) can be bent and stretched, and as the skeleton of the doll, the doll can be flexibly moved and make a variety of poses.

As shown in FIG. 3, the main frame body (1) and the limbs (2) are covered with an outer material, which refers to a doll made of an elastic outer material whose appearance is not limited to that shown in FIG. 3, but the limbs of the doll can be arbitrarily bent and stretched according to demand, so that the doll can make a variety of poses. When an animal doll is made, the animal generally has a tail, and a hole (103) for mounting the tail is provided on the front or back of the lower frame (12), the hole (103) is fitted with a fully flexible support to form a tail.

Figure 4:
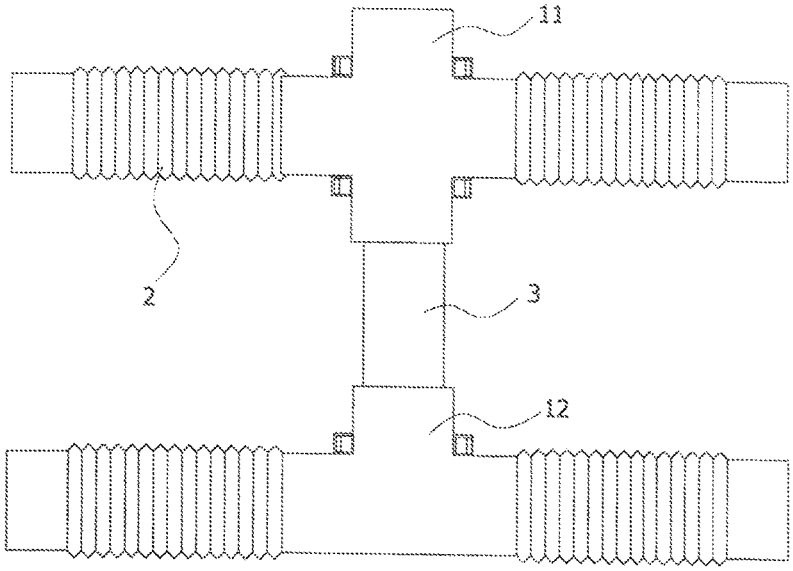
FIG. 4 is a schematic structural view of a second embodiment of the present invention.

As shown in FIG. 4, the pipe body (3) may use a rigid structure in addition to the stretchable structure, the upper frame (11) and the lower frame (12) with the stretchable structures can be stretched and deformed, and the rigid structure is not deformable. The second embodiment is a skeleton made of a rigid structure.

Figure 5:
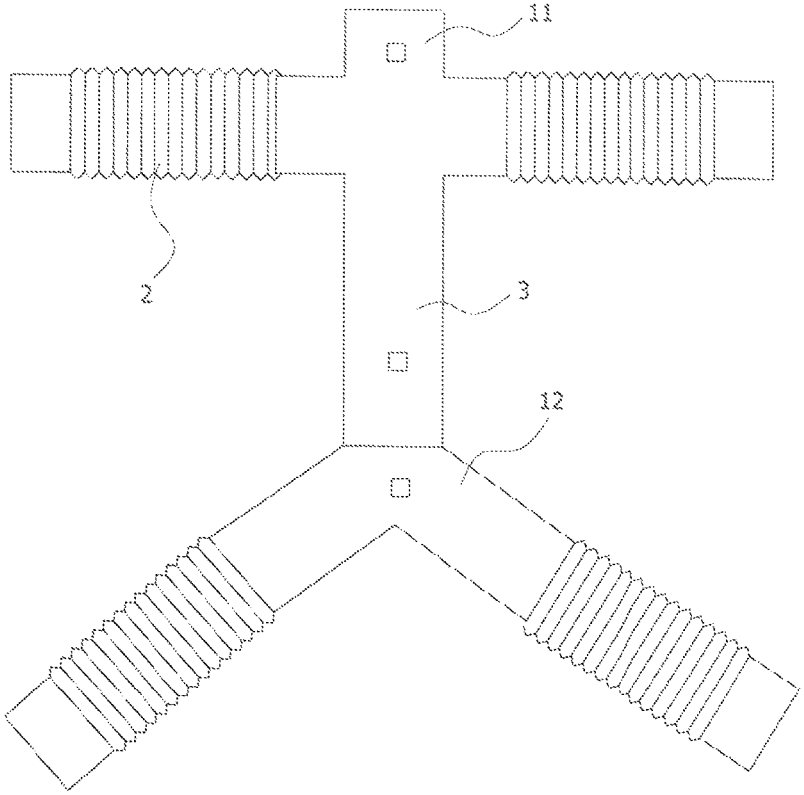
FIG. 5 is a schematic structural view of a third embodiment of the present invention.

In addition, depending on the doll shape, the shape of the main frame body (1) may be changed, as shown in FIG. 5, in the third embodiment, the main frame body (1) may be composed of the upper frame (11) and the lower frame (12), the lower end of the upper frame (11) extends downwardly to form the pipe body (3) and is fixedly connected to the lower frame (12) by the pipe body (3). The shape of the lower frame (12) may also be provided as desired.

The above only describes some exemplary embodiments of the present invention. Those having ordinary skills in the art may also make many modifications and improvements without departing from the conception of the invention, which shall all fall within the protection scope of the invention.

I claim:

1. An arbitrarily shaped skeleton, comprising:

a main frame body and limbs disposed on the main frame body;

wherein the main frame body is formed with mounting holes for mounting the limbs, one end of the limb is mounted in the mounting hole, and the limb is made of a telescopic structure which can be arbitrarily bent and stretched;

wherein the main frame body includes an upper frame and a lower frame, and the upper frame and the lower frame are connected by a pipe body, the upper frame and the lower frame are formed with the mounting holes at both ends thereof, four limbs are installed in the mounting holes of the upper and lower frames to form a skeleton;

wherein the upper frame includes symmetrical front and rear portions, and the front and rear portions are engaged with each other through snap connectors (104, 105) to form a cross-shaped pipe; the lower frame includes symmetrical front and rear portions, and the front and rear portions are engaged with each other through snap connectors to form a T-shaped pipe.

2. The arbitrarily shaped skeleton according to claim 1, wherein the mounting holes are threadedly connected to the limbs.

3. The arbitrarily shaped skeleton according to claim 1, wherein the limbs are hollow tubes, and the walls thereof are formed in a stretchable pleated shape.

4. The arbitrarily shaped skeleton according to claim 1, wherein the pipe body is a rigid structure.

5. The arbitrarily shaped skeleton according to claim 1, wherein the pipe body is a stretchable structure.

6. The arbitrarily shaped skeleton according to claim 1, wherein the upper frame includes connecting holes disposed in upper and lower ends thereof, the lower frame also includes the connecting hole disposed at an upper end thereof, both ends of the pipe body are attached to the connecting holes of the upper frame and the lower frame so that the upper frame and the lower frame are connected.

7. The arbitrarily shaped skeleton according to claim 6, wherein the lower frame includes a hole disposed on a front side or a back side thereof for mounting a tail.

* * * * *